United States Patent [19]

Najjar et al.

[11] Patent Number: 4,880,439

[45] Date of Patent: Nov. 14, 1989

[54] HIGH TEMPERATURE DESULFURIZATION OF SYNTHESIS GAS

[75] Inventors: Mitri S. Najjar, Hopewell Junction, N.Y.; Allen M. Robin, Anaheim, Calif.

[73] Assignee: Texaco Inc., White Plains, N.Y.

[21] Appl. No.: 190,707

[22] Filed: May 5, 1988

[51] Int. Cl.[4] ..... C10J 3/46

[52] U.S. Cl. ..... 48/197 R; 48/206; 48/215; 48/DIG. 2

[58] Field of Search ..... 48/197 R, 202, 203, 48/206, 210, 215, 209, DIG. 7, DIG. 2; 252/373; 422/230

[56] References Cited

U.S. PATENT DOCUMENTS

| | | | |
|---|---|---|---|
| 1,799,885 | 4/1931 | Chavanne . | |
| 2,644,745 | 7/1953 | Hemminger | 48/203 |
| 4,328,008 | 5/1982 | Muenger et al. | 48/197 R |
| 4,374,105 | 2/1983 | Anderson et al. | 423/230 |
| 4,444,568 | 4/1984 | Beisswenger et al. | 48/206 |
| 4,579,070 | 4/1986 | Lin et al. | 431/7 |
| 4,613,344 | 9/1986 | Henrich et al. | 48/210 |
| 4,657,698 | 4/1987 | Najjar et al. | 253/373 |
| 4,705,539 | 11/1987 | Najjar et al. | 48/197 |
| 4,776,860 | 10/1988 | Najjar et al. | 252/373 |
| 4,778,485 | 10/1988 | Suggitt et al. | 252/373 |

FOREIGN PATENT DOCUMENTS

| | | | |
|---|---|---|---|
| 2263196 | 11/1975 | France | 48/197 R |
| 2104092 | 3/1983 | United Kingdom | 48/197 R |
| 2180849 | 4/1987 | United Kingdom | 48/210 |

*Primary Examiner*—Peter Kratz

*Attorney, Agent, or Firm*—Robert A. Kulason; James J. O'Loughlin; Albert Brent

[57] ABSTRACT

The hot process gas stream from the partial oxidation of sulfur-containing heavy liquid hydrocarbonaceous fuel and/or sulfur-containing solid carbonaceous fuel comprising gaseous mixtures of $H_2+CO$, sulfur-containing gases, entrained particulate carbon, and molten slag is passed through the unobstructed central passage of a radiant cooler where the temperature is reduced to a temperature in the range of about 1800° F. to 1200° F. From about 0 to 95 wt. % of the molten slag and/or entrained material may be removed from the hot process gas stream prior to the radiant cooler with substantially no reduction in temperature of the process gas stream. In the radiant cooler, after substantially all of the molten slag has solidified, the sulfur-containing gases are contacted with a calcium-containing material to produce calcium sulfide. A partially cooled stream of synthesis gas, reducing gas, or fuel gas containing entrained calcium sulfide particulate matter, particulate carbon, and solidified slag leaves the radiant cooler containing a greatly reduced amount of sulfur-containing gases.

22 Claims, No Drawings

HIGH TEMPERATURE DESULFURIZATION OF SYNTHESIS GAS

The Government of the United States of America has rights in this invention pursuant to Contract No. DE-FC21-87MC23277 awarded by the U.S. Department of Energy.

BACKGROUND OF THE INVENTION

This invention relates to the gasification of sulfur-containing liquid hydrocarbonaceous fuel or a slurry of sulfur-containing solid carbonaceous fuel. More specifically it relates to the removal of sulfur-containing gases from the raw effluent synthesis gas stream produced in a refractory lined free-flow gas generator.

As supplies of petroleum gradually diminish sulfur-containing heavy liquid hydrocarbonaceous fuel and/or sulfur-containing coal which is America's most abundant form of fossil fuel will play an increasingly major role in providing for the nation's energy requirements. One ton of coal contains the same amount of energy as three to four barrels of crude oil. Accordingly, in the future it will become necessary to produce an increasing fraction of liquid and gaseous fuels from these sulfur-containing comparatively low cost fuels. The synthesis, reducing, and fuel gases produced from these sulfur-containing materials contain a comparatively high e.g. from about 0.1 to 2.0 mole % of $H_2S$ and COS. The desirability for removing at high temperature a major share of the sulfur present in synthesis gas as generated in the Partial Oxidation Gasification Process is widely recognized. In particular, removing sulfur from syngas at high temperatures would improve combined cycle thermal efficiency and decrease costs by eliminating the need for cooling product gases prior to scrubbing. When the synthesis gas is burned as fuel in a gas turbine, it may be unnecessary to remove the last trace of sulfur. Energy savings such as are possible through a high temperature (circa 1000° F.) desulfurization process can outweigh the need to get an extremely low sulfur content fuel gas. The gas produced by this invention may be used with or without further processing and/or purification as a gaseous fuel or as feedstock for the catalytic synthesis of liquid fuels.

Synthesis gas, fuel gas, and reducing gas may be produced from coal by well known gasification processes. For example, coassigned U.S. Pat. Nos. 3,544,291 and 4,289,502 respectively relate to a process for the partial oxidation of slurries of coal, and to an apparatus for producing cleaned and cooled synthesis gas by the partial oxidation of solid carbonaceous fuel. The subject invention is superior to the mode wherein iron oxide is mixed with the fuel feedstock to the gasifier, such as described in coassigned U.S. Pat. No. 4,668,428, since calcium can accept more sulfur at the lower temperature in the radiant cooler of the subject invention. Further, the thermal energy produced by the sulfur removal reaction may be now recovered in the radiant cooler.

The use of an iron-containing additive to react with sulfur-containing gases in a stream of synthesis gas is described in coassigned copending U.S. patent application Ser. No. 07/090,822, now U.S. Pat. No. 4,778,485 which is incorporated herein by reference. However, it was unexpectedly found that at the lower temperatures resulting after cooling the process gas stream to solidify the slag, as provided by the invention described herein, calcium is more potent than iron for capturing sulfur in-situ. For example, at a temperature of 1500° F., 98.2% of the sulfur may be removed as CaS in comparison with 87.4% of the sulfur removed as FeS.

SUMMARY OF THE INVENTION

This is a continuous process for producing a desulfurized stream of synthesis gas fuel gas or reducing gas by the non-catalytic partial oxidation of sulfur-containing heavy liquid hydrocarbonaceous fuel and/or sulfur-containing solid carbonaceous fuel with a free-oxygen containing gas. A liquid or gaseous carrier is used to introduce the solid fuel into the down-flowing unobstructed vertical reaction zone of the gas generator. An effluent gas stream is first produced by the partial oxidation of the sulfur-containing heavy liquid hydrocarbonaceous fuel and/or sulfur-containing solid carbonaceous fuel in the free-flow non-catalytic refractory lined gas generator at a temperature in the range of about 1900° F. to 2900° F. and above the ash-fusion temperature of the slag formed in the reaction zone, and a pressure in the range of about 2 to 250 atmospheres. A temperature moderator such as $H_20$ may be employed when the liquid carrier is a liquid hydrocarbon fuel. It was unexpectedly found that by controlling the equilibrium oxygen concentration in the gas phase, the efficiency of the downstream desulfurization reactions which take place after cooling the gas stream is improved.

The partial oxidation gas generator is operated so as to convert from about 75 to 99 wt. % of the carbon in the fuel feed to the reaction zone into carbon oxides. The hot effluent gas stream leaving the gas generator comprises $H_2$, CO, $CO_2$, $H_2S$, COS and at least one gaseous material from the group consisting of $H_2O$, $N_2$, $CH_4$, $NH_3$, and Ar. Further, entrained in the hot effluent gas stream leaving the reaction zone is particulate carbon e.g. any remaining unconverted fuel and/or soot and the non-combustible inorganic ash portion of the fuel e.g. molten slag from the reacted portion of the solid carbonaceous fuel.

At least a portion e.g. about 20 to 100 volume % of the hot effluent gas stream leaving the reaction zone of the gas generator, with from 0 to 95 wt. % of the molten slag removed, is passed through an unobstructed vertical central passage of a free-flow radiant cooler. The remainder of the hot effluent gas stream, if any, may be cooled in a quench tank such as shown and described in coassigned U.S. Pat. No. 4,328,006, which is incorporated herein by reference. The process gas stream is cooled in a radiant cooler to a temperature in the range of about 1800° F. to 1200° F., such as about 1800° F. to 1500° F., and below the ash-fusion temperature. Substantially all e.g. greater than 99 wt. % of the molten slag in the process gas stream is solidified during this cooling step. This cooling step is important to reduce the amount of calcium-containing material used in the process. There is substantially no reaction between the solidified slag and the calcium-containing material. Accordingly, no additional calcium silicates, are formed. The calcium-containing material is introduced into the hot effluent gas stream at one or more locations within the radiant cooler after the molten slag has solidifed. Sufficient calcium-containing material is introduced into the hot effluent gas stream so as to provide in the radiant cooler a weight ratio of calcium-containing material to sulfur in the fuel feed in the range of about 0.8–5.0 to 1.0.

A tube-wall comprising pipes or coils through which cooling water is passed line the inside walls of the radiant cooler. By this means, the temperature of the stream of hot effluent gas passing through the radiant cooler is controlled. The hot effluent gas stream enters the radiant cooler at a temperature in the range of 1900° F. to 2900° F. and leaves at a temperature in the range of about 1200° F. to 1800° F., such as about 1800° F. to 1500° F. Cooling is effected by noncontact indirect heat exchange.

As the effluent gas stream passes through the unobstructed central passage of the radiant cooler, at least a portion i.e. about 50–100 weight percent and preferably all of the sulfur-containing gases in the effluent gas stream e.g. $H_2S$ and COS react with the calcium-containing material to produce particulate matter comprising calcium sulfide. A partially cooled process stream of synthesis gas, reducing gas, or fuel gas leaves the radiant cooler containing entrained particulate matter comprising calcium sulfide, particulate carbon, and solidified slag. The particulate matter may be separated from the effluent gas stream by conventional gas-solids separation means, roasted to convert the calcium sulfide to calcium sulfate, and then discarded without polluting the environment. Alternatively, the calcium sulfide particles, particulate carbon and solidfied slag may be removed from the effluent gas stream by scrubbing with a suitable washing agent. Advantageously, portions of the sensible heat in the stream of hot effluent gas from the partial oxidation reaction zone and from the exothermic reactions going on in the radiant cooler are recovered by indirect heat exchange with the cooling water flowing through the tube-wall in the radiant cooling zone. By-product steam may be thereby produced. Further, the desulfurized product gas is available for use at a higher temperature. Costly reheating is thereby avoided.

In one embodiment with or without introducing calcium-containing material into the radiant cooler in the manner previously described, calcium-containing material is introduced into a reaction vessel located immediately down stream from the radiant cooler. Reaction between the calcium-containing material and the sulfur-containing gases in the precooled process gas stream in said reaction vessel takes place at temperature of at least about 50° to 200° F. below the ash-fusion temperature of the solidifed slag entrained in the process gas stream. Production of calcium sulfide is more efficient at the lower temperature prevailing in said reaction vessel.

DESCRIPTION OF THE INVENTION

The present invention pertains to a continuous process for the production of a desulfurized stream, of synthesis gas, fuel gas, or reducing gas from sulfur-containing heavy liquid hydrocarbonaceous fuel and/or sulfur-containing solid carbonaceous fuel in a liquid or gaseous carrier. The hot effluent gas stream is desulfurized in-situ, after the hot effluent gas from the gas generator is cooled in a radiant cooler to a temperature in the range of about 1200° F. to 1800° F., and below the ash-fusion temperature.

A typical down-flowing partial oxidation synthesis gas generator is shown in coassigned U.S. Pat. No. 2,818,326. The gas generator is a vertical cylindrical steel pressure vessel lined on the inside with a thermal refractory material. A burner is located in the top of the gas generator along the central vertical axis for introducing the feed streams. A suitable annulus-type burner is shown in coassigned U.S. Pat. No. 2,928,460.

The term sulfur-containing solid carbonaceous fuel includes coal, such as anthracite, bituminous, subbituminous; coke from coal; lignite; residue derived from coal liquefaction; oil shale; tar sands; petroleum coke; asphalt; pitch; particulate carbon (soot); concentrated sewer sludge; and mixture thereof. The sulfur content of the solid carbonaceous fuel is in the range of about 0.2 to 6.0 wt. %. The ash or inorganic portion of the solid carbonaceous fuel is in the range of about 0.1 to 30 wt. %. Ash from solid carbonaceous fuel substantially comprises the oxides and some sulfides of Si, Fe, V, Ni, and Al. The solid carbonaceous fuel may be ground to a particle size so that 100% passes through an ASTM E11-70 Sieve Designation Standard (SDS) 1.40 mm Alternative No. 14. Pumpable slurries of solid carbonaceous fuels may have a solids content in the range of about 25–70 wt. % such as 45–68 wt. %, depending on the characteristics of the fuel and the slurring medium. The slurring medium may be water, liquid hydrocarbon, or both.

The term sulfur-containing heavy liquid hydrocarbon fuel, as used herein, is intended to include various materials, such as virgin crude, residue from petroleum distillation and cracking, petroleum distillates, reduced crude, whole crude, asphalt, coal tar, coal derived oil, shale oil, tar sand oil and mixtures thereof. The sulfur and ash contents of the heavy liquid hydrocarbonaceous fuel are respectively in the ranges of about 0.5 to 5.0 weight %; and 100 to 10,000 parts per million. Ash from heavy liquid hydrocarbonaceous fuel substantially comprises the oxides and some sulfides of Fe, Ni, V, and Si.

The use of a temperature moderator to moderate the temperature in the reaction zone of the gas generator depends in general on the carbon to hydrogen ratio of the feedstock and the oxygen content of the oxidant stream. Suitable temperature moderators include steam, water, $CO_2$-rich gas, liquid $CO_2$, recycle synthesis gas, a portion of the cooled clean exhaust gas from a gas turbine employed downstream in the process with or without admixture with air, by-product nitrogen from the air separation unit used to produce substantially pure oxygen, and mixtures of the aforesaid temperature moderators. Water serves as the carrier and the temperature moderator with slurries of liquid hydrocarbon fuels and solid carbonaceous fuel. However, steam may be the temperature moderator with slurries of liquid hydrocarbon fuels and solid carbonaceous fuel. Generally, a temperature moderator is used with liquid hydrocarbon fuels and with substantially pure oxygen. The temperature moderator may be introduced into the gas generator in admixture with either the solid carbonaceous fuel feed, the free-oxygen containing steam, or both. Alternatively, the temperature moderator may be introduced into the reaction zone of the gas generator by way of a separate conduit in the fuel burner. When $H_2O$ is introduced into the gas generator either as a temperature moderator, a slurring medium, or both, the weight ratio of water to the solid carbon in the solid carbonaceous fuel plus liquid hydrocarbon fuel if any, is in the range of about 0.3 to 2.0 and preferably in the range of about 0 5 to 1.0.

The term free-oxygen containing gas, as used herein, is intended to include air, oxygen-enriched air, i.e. greater than 21 mole % of oxygen, and substantially pure oxygen, i.e.., greater than 95 mole % oxygen, (the remainder comprising $N_2$ and rare gases). Free-oxygen containing gas may be introduced into the burner at a temperature in the range of about ambient to 1200° F. The atomic ratio of free-oxygen in the oxidant to carbon in the feed stock (0/C atom/atom) is preferably in the range of about 0.7 to 1.5, such as about 0.80 to 1.2.

The relative proportions of solid carbonaceous fuel, liquid hydrocarbon fuel if any, water or other temperature moderator, and oxygen in the feed streams to the gas generator, are carefully regulated to convert a substantial portion of the carbon in the fuel feed to the partial oxidation gas generator e.g. 75 to 99 wt. %, such as 80 to 90 wt. % of the carbon to carbon oxides e.g. CO and $CO_2$ and to maintain an autogenous reaction zone temperature in the range of about 1900° F. to 2900° F., and above the ash-fusion temperature of the slag formed in the reaction zone e.g. above about 50° F. to 200° F. Further, the equilibrium oxygen concentration in the gas phase in the reaction zone of the gas generator is controlled to provide a partial pressure in the range of less than about $7.7\times10^{-14}$ atmospheres at a temperature of about 1900° F., less than about $5.8\times10^{-10}$ atmospheres at a temperature of about 2500° F., and less than about $2.1\times10^{-9}$ atmospheres at a temperature of about 2900° F. With sulfur-containing solid carbonaceous feeds, the ash in the solid carbonaceous fuel forms molten slag at such reaction temperatures. Molten slag is much easier to separate from the hot effluent gas than fly-ash. The pressure in the reaction zone is in the range of about 2 to 250 atmospheres. The time in the reaction zone of the partial oxidation gas generator in seconds is in the range of about 0.5 to 10, such as normally about 1.0 to 5.

The effluent gas stream leaving the partial oxidation gas generator has the following composition in mole % $H_2$ 8.0 to 60.0, CO 8.0 to 70.0, $CO_2$ 1.0 to 50.0, $H_2O$ 2.0 to 50.0, $CH_4$ 0.0 to 2.0, $H_2S$ plus COS 0.10 to 2.0, $N_2$ 0.0 to 80.0, and Ar 0.0 to 2.0. Trace amounts of the following gaseous impurities may be also present in the effluent gas stream in parts per million (ppm): HCN 0 to 100; such as about 2 to 20; HCl 0 to about 20,000 , such as about 200 to 2,000; and $NH_3$ 0 to about 10,000, such as about 100 to 1000. Entrained in the effluent gas stream is about 0.5 to 20 wt. %, such as 1 o 4 wt. % particulate carbon (basis weight of carbon in the feed to the gas generator) comprising the remaining portion of the unconverted ash-containing solid carbonaceous fuel feed and/or soot. Molten slag resulting from the fusion of the ash content in the coal is also entrained in the gas stream leaving the generator.

At least a portion e.g. about 20 to 100 volume % of the effluent gas stream leaving the reaction zone of partial oxidation gas generator at a temperature in the range of about 1900° F. to 2900° F. is passed through the unobstructed central axial passage of a radiant cooler. The calcium-containing material may be introduced into the hot effluent gas stream at one or more locations within the radiant cooler after substantially all e.g. greater than 95 wt. % of the molten slag has solidifed. The temperature of the process gas stream is reduced to a temperature in the range of about 1800° F. to 1200° F., such as about 1800° F. to 1500° F. Advantageously, in the form of particulate solid matter, the solid slag particles will not react with the calcium-containing materials to produce calcium silicate. Accordingly, at a great economic savings, all of the calcium-containing additive may be used for desulfurization. Sufficient calcium-containing material is introduced into the hot effluent gas stream so as to provide in the radiant cooler a weight ratio of calcium-containing additive to sulfur in the fuel feed in the range of about 0.8–5.0 to 1.0. The hot effluent gas stream from the gas generator may be passed in a downward or upward direction through the radiant cooler. For example, a radiant cooler may be connected directly in succession to the discharge outlet of the gas generator, in an arrangement such as shown in U.S. Pat. No. 2,801,158 and in coassigned U.S. Pat. No. 3,551,347, which are incorporated herein by reference.

In one embodiment, refractory-lined first and/or second slag and residue separation chambers may be connected between the discharge outlet of the reaction zone of the gas generator and the inlet to the radiation cooler for separation of a portion of the entrained matter by gravity. For example, see coassigned U.S. Pat. No. 4,251,228, which is incorporated herein by reference. By this means, from about 0 to 95 wt. %, or more, of the molten slag and/or combustion residue entrained in the effluent gas stream leaving the reaction zone may be removed prior to the radiant cooler. This may be done with substantially no reduction in temperature of the effluent gas stream by gravity and/or gas-solids separation means, such as by cyclone or impingement separators. This mode is shown and described in coassigned U.S. Pat. Nos. 4,328,006 and 4,377,394, which are incorporated herein be reference.

Any suitable radiant cooler, such as those in the previously mentioned references, may be used in the subject process. The radiant cooler essentially comprises an elongated cylindrically shaped vertical pressure vessel. The steel walls of the vessel are lined on the inside with a tube-wall which may extend through the full length of the vessel. A coolant such as cooling water or water and steam flows through the individual tubes of the tube-wall. By this means the outer shell of the radiant cooler is protected against the hot gas stream flowing freely through the unobstructed longitudinal central passage of the vessel which is surrounded by said tube-wall. The tube-wall comprises a plurally of adjacent contacting rows of vertical tubes or coils in a concentric ring that is radially spaced from the central longitudinal axis of the vessel.

In one embodiment, a plurality of thin-walled vertical tubes, with or without side fins, line the inside walls of the radiant cooler. The adjacent rows of tubes are longitudinally welded together to make an annular gas-tight wall of tubes. The lower and upper ends of each of said tubes may be respectively connected to lower and upper annular shaped headers. When the coolant in the tube wall is water or a mixture of water and steam, the highest temperature that the pressure shell can reach is the temperature of the saturated steam within the radiant cooler. Boiler feed water is introduced into the bottom header and then passes up through the plurality of separate upright tubes into the top header. The mixture of steam and water is removed from the top header and introduced into an external steam drum where separation takes place. The saturated steam removed from the steam drum may be used elsewhere in the process to provide heat or power. Optionally, at least a portion of the saturated steam may be superheated. The hot water separated in the steam drum may be returned to the bottom header of the radiant cooler. Optionally, for cleaning and maintenance, a plurality of nozzles may be secured on the outside of the tube-wall. By this means, a stream of water, steam, or air may be directed against the tube-wall. Thus, the tube-wall may be washed down with water, and any slag deposited thereon may be removed by the wash water. In one embodiment, the inside surfaces of the radiant cooler and the outside surfaces of the tubing in the radiant cooler are provided with a protective metal which substantially reduces any sticking or build-up of slag. See coassigned U.S. patent application Ser. No. 07/045,632 filed May 4, 1987, now U.S. Pat. No. 4,788,003 which is incorporated herein by reference.

The hot effluent gas stream may enter through either end of the vertical radiant cooler and freely flow through the unobstructed central core. The temperature of the hot effluent gas stream is steadily reduced as it flows through the radiant cooler. By radiation and convection, a portion of the sensible heat in the hot effluent gas stream is absorbed by indirect heat exchange with the cooling water and steam flowing inside of the tube-wall. The temperature of the gas stream is primarily controlled by this means.

The calcium-containing material having a particle size (microns) in the range of about 1.0 to 1000, such as about 5.0 to 100, may be sprayed into the effluent gas stream passing through the unobstructed central passage of the radiant cooler by means of spray nozzles, aspirators or atomizers. The calcium-containing material may be introduced into the hot raw process gas stream as a dry powder or entrained in a liquid or gaseous carrier. Liquid carriers for the calcium-containing material include water and liquid hydrocarbon fuel carriers. The equilibrium oxygen concentration in the gas phase in the reaction zone e.g. radiant cooler and/or a reaction vessel located downstream from the radiant cooler is preferably controlled to provide a partial pressure of oxygen in the range of less than about $1.7\times10^{-15}$ atmospheres at a temperature of about 1800° F. and less than about $5.3\times10^{31\ 23}$ atmospheres at a temperature of about 1200° F.

Any suitable number and arrangement of spray nozzles, aspirators, atomizers, or other suitable mixing means may be employed which allow the calcium-containing material to intimately contact and mix with the hot effluent gas stream. For example, at least one spray nozzle may be located within the radiant cooler downstream from the entrance and where the temperature of the molten slag is reduced below the ash fusion temperature. At this point the partially cooled process gas stream is contacted by an atomized spray of calcium-containing material. At least one spray nozzle for spraying calcium-containing material may be longitudinally spaced at various levels in the radiant cooler beyond the first spray nozzle.

In one embodiment, a slurry of calcium-containing additive material in a liquid hydrocarbon fuel having a solids content in weight % in the range of about 30 to 90, such as about 60 to 80, and at a temperature in the range of about ambient to 200° F. is mixed with the hot effluent gas stream from the partial oxidation gas generator. The rate of introduction and concentration of the slurry are such that after the liquid hydrocarbon carrier is vaporized the weight ratio of the calcium-containing material that becomes intimately associated with the sulfur-containing gases in the effluent gas passing through the radiant cooler is in the range of about 0.8 to 5.0 parts by wt. of calcium-containing material for each part by wt. of sulfur in the fuel feed. The dwell time of the hot gas stream passing through the radiant cooler is in the range of about 5 to 50 seconds, such as 15 to 40 seconds. In another embodiment, the calcium-containing additive is entrained in a gaseous medium selected from the group consisting of steam, air $CO_2$, $N_2$, recycle synthesis gas, and mixtures thereof.

By the subject process, in the radiant cooler at least a portion e.g. 50 to 100 wt. %, such as about 70 to 95 wt. % of the sulfur originally present in the fuel feed and in the form of sulfur-containing gases e.g. $H_2S$, COS reacts with the calcium-containing material to produce particulate matter comprising calcium sulfide. Substantially no new calcium silicates are formed in the radiant cooler. Further, the mole % $H_2S+COS$ in the effluent gas stream from the gas generator is reduced from a mole % of about 0.10 to 2.0 to less than about 0.05 mole % by the subject process.

The calcium-containing material may comprise a calcium-compound selected from the group consisting of calcium oxide, calcium hydroxide, calcium carbonate, calcium hydrate, calcium nitrate, calcium phosphate, and mixtures thereof.

In another embodiment, a metallic oxide from the group consisting of copper oxide, zinc oxide, and mixtures thereof is mixed with said calcium-containing additive. For example from 1 to 50 wt. %, such as about 2 to 10 wt. %, of said metallic oxide (basis weight of said calcium-containing material) may be mixed with said calcium-containing additive. The oxides of copper and/or zinc like the calcium oxide form sulfides. In addition, copper and zinc oxides catalyze the reactions between steam and carbon in the radiant cooler to produce supplemental $H_2+CO$, and to complete the conversion of any unburned fuel or soot that may come from the partial oxidation unit.

In a preferred embodiment, with at least a portion of the molten slag removed, the gas stream enters the radiant cooler at substantially the same temperature as that which it had when it left the reaction zone of the partial oxidation gas generator i.e. about 1900° F. to 2900° F., less any ordinary drop in the lines i.e. about 50° F. 100° F. temperature drop. Preferably, the temperature of the entering gas stream is above the ash-fusion temperature of any slag that may be entrained in the gas stream. The partially cooled gas stream leaves at the opposite end of the radiant cooler after its temperature has been reduced to a temperature in the range of about 1200° F.–1800° F., such as about 1500° F.–1800° F., say at least about 50° F. to 200° F. below the ash-fusion temperature. The pressure of the gas stream in the radiant cooler is substantially the same as that in the gas generator, less ordinary pressure drop in the line i.e. about 1 atmosphere pressure drop. At these temperatures and pressures, sulfur-containing gases e.g. $H_2S$ and COS that were produced in the partial oxidation reaction zone along with the effluent gas stream comprising $H_2+CO$ react with the calcium-containing material to produce calcium sulfide. The calcium sulfide leaves the radiant cooler in the form of discrete solid particles entrained in the effluent gas stream along with the solid slag particles and particles of particulate carbon e.g. unconverted fuel particles and/or soot. The entrained solid particles are separated from the effluent gas stream by conventional gas-solids separation means. In one embodiment, the entrained solid particles are separated from the partially cooled and desulfurized stream of synthesis gas leaving the radiant cooler by means of a cyclone separator or impingement separator of the types shown in coassigned U.S. Pat. Nos. 4,328,006 and 4,377,394, which are incorporated herein by reference. By oxidizing the mixture of particulate solids, calcium sulfide in the mixture may be converted into $CaSO_4$. The mixture of particulate matter may be then readily disposed without polluting the environment.

Advantageously, useful thermal energy may be recovered from exothermic reactions that take place in the radiant cooler. By indirect heat exchange between the hot gas stream flowing through the central passageway of the radiant cooler and the cooling water flowing through the tube-wall, by-product steam may be produced.

The comparatively clean, desulfurized and partially cooled gas stream may leave the downstream end of the gas solids separation zone at a temperature below the maximum safe operating temperature for downstream devices used to recover energy from the hot gas stream, such as a conventional expansion turbine for the production of mechanical or electrical energy, or both. Alternatively, the gas stream may be passed through a downstream convection-type gas cooler or some other energy utilizing means where its temperature is reduced still further to a range of about 150° F. to 600° F. The gas stream may be then optionally subjected to additional process steps including gas scrubbing, methanation reactions, and purification, depending on its intended use as a synthesis gas, reducing gas, or fuel gas.

The advantages achieved by the subject process in which the calcium-containing material is introduced directly into the radiant cooler include the following:

1. A $H_2+CO$ containing product gas is produced containing a reduced amount of sulfur-containing gases.

2. A smaller amount of calcium-containing material is used in the desulfurization process since there is substantially no calcium lost by reaction with slag.

3. The gas stream passing through the radiant cooler is desulfurized while the temperature is maintained at a high level e.g. greater than 1000° F.

4. The sensible heat in the effluent gas stream from the partial oxidation gas generator may be efficiently used at high temperatures to provide the necessary energy to initiate and to carry out the desulfurization reaction.

5. The calcium-containing additive may be intimately mixed with the sulfur-containing gases in the hot gas stream in the radiant cooler. The conversion rate for the desulfurization reaction is thereby increased.

Other modifications and variations of the invention as hereinbefore set forth may be made without departing from the spirit and scope thereof, and therefore only such limitations should be imposed on the invention as are indicated in the appended claims.

We claim:

1. A continuous process for the production of desulfurized synthesis gas, fuel gas, or reducing gas comprising:

(1) reacting sulfur-containing heavy liquid hydrocarbonaceous fuel and/or sulfur-containing solid carbonaceous fuel by partial oxidation with a free-oxygen containing gas and in the presence of a temperature moderator in the free-flow refractory lined reaction zone of a gas generator at an autogenous temperature in the range of about 1900° F and above the ash-fusion temperature of the slag formed in the reaction zone, and a pressure in the range of about 2 to 250 atmospheres to produce a hot stream of synthesis gas, reducing gas, or fuel gas comprising $H_2$, CO, $CO_2$, $H_2S$, COS and at least one gaseous material selected from the group consisting of $H_2O$, $N_2$, $CH_4$, $NH_3$, Ar, and containing entrained material comprising particulate carbon, and molten slag;

(2) passing the hot gas stream from (1) through an unobstructed central passage of a radiant cooler, thereby cooling the process gas stream to a temperature in the range of about 1800° F. to 1200° F. while solidifying the molten slag;

(3) contacting the sulfur-containing gases in the process gas stream in said radiant cooler with a calcium-containing material after substantially all of the said molten slag has solidified, wherein said calcium-containing material is introduced into the cooled process gas stream at one or more locations within said radiant cooler, the weight ratio of calcium-containing material to sulfur is in the range of about 0.8 to 5.0 to 1.0; and the partial pressure of oxygen in the radiant cooler is in the range of less than about $1.7\times10^{31\ 15}$ atmospheres at a temperature of about 1800° F. and less than about $5.3\times10^{31\ 23}$ atmospheres at a temperature of about 1200° F.;

(4) reacting in said radiant cooler said calcium-containing material with sulfur-containing constituents in said gas stream to produce particulate matter comprising calcium sulfide; and (5) discharging from said radiant cooler a partially cooled process stream of synthesis gas, reducing gas, or fuel gas containing entrained calcium sulfide particulate matter, particulate carbon, and slag; and in comparison with a gas stream produced without the introduction of said calcium-containing additive in (3), said cooled process gas stream contains a reduced amount of sulfur-containing gases.

2. The process of claim 1 where in step (1) the partial pressure of oxygen in the reaction zone of the gas generator is in the range of less than about $7.7\times10^{31\ 14}$ atmospheres at a temperature of about 1900° F. and less than about $5.8\times10^{31\ 10}$ atmospheres at a temperature of about 2500° F.

3. The process of claim 1 wherein the central passage of said radiant cooler is surrounded by a tube-wall through which cooling water is passed.

4. The process of claim 1 wherein the hot gas stream passing through the central passage of said radiant cooler is contacted in (3) with an atomized spray of said calcium-containing material.

5. The process of claim 1 wherein the calcium-containing material in (3) is a calcium compound selected from the group consisting of calcium oxide, calcium hydroxide, calcium carbonate, calcium hydrate, calcium, nitrate, calcium phosphate, and mixtures, thereof.

6. The process of claim 1 wherein the dwell times in the partial oxidation gas generator in (1) and in the radiant cooler in (3) are respectively in the ranges of about 0.5 to 10 seconds and about 5 to 50 seconds.

7. The process of claim 1 wherein the hot stream of gas leaving the gas generator in (1) is introduced into the radiant gas cooling zone in (2) with substantially no change in temperature and pressure, except for ordinary losses of temperature and pressure in the lines.

8. The process of claim 1 wherein from about 0 to 95 wt. % of the molten slag and/or entrained material in the hot gas stream leaving the gas generator in (1) are removed respectively by gravity and gas-solids separation means prior to introducing the hot gas stream into the radiant cooler in (2).

9. The process of claim 1 wherein said sulfur-containing solid carbonaceous fuel is selected from the group consisting of coal, coke from coal; lignite; residue derived from coal liquefaction; oil shale; tar sands; petroleum coke; asphalt; pitch; particulate carbon (soot); and mixtures thereof.

10. The process of claim 1 wherein the calcium-containing material in (3) is introduced into a vertical radiant cooler at one or more levels along the height of said radiant cooler.

11. The process of claim 1 wherein said sulfur-containing liquid hydrocarbonaceous or solid carbonaceous fuel is introduced into said partial oxidation reaction zone entrained in a liquid or gaseous carrier.

12. The process of claim 11 wherein said liquid carrier is selected from the group consisting of water, liquid hydrocarbonaceous fuel, and mixtures thereof.

13. The process of claim 11 wherein said gaseous carrier is selected from the group consisting of steam, air, $N_2$, $CO_2$, recycle synthesis gas, and mixtures thereof.

14. The process of claim 1 in which said temperature moderator is selected from the group consisting of steam, water, $CO_2$-rich gas, liquid $CO_2$, $N_2$, recycle synthesis gas, exhaust gas from a turbine, and mixtures thereof.

15. The process of claim 1 in which said free-oxygen containing gas is selected from the group consisting of air, oxygen-enriched air, i.e. greater than 21 mole % $O_2$, and substantially pure oxygen, i.e. greater than about 95 mole % $O_2$.

16. The process of claim 1 where a coolant comprising water or a mixture of water and steam is passed through said radiant cooler and by-product steam is produced by indirect heat exchange with said hot process gas stream.

17. The process of claim 1 provided with the steps of separating particulate matter comprising calcium sulfide, slag and particulate carbon from the cooled process gas stream from (5) in a gas-solids separation zone.

18. The process of claim 17 provided with the steps of roasting said particulate matter thereby converting said calcium sulfide to calcium sulfate, and discarding the roasted material.

19. The process of claim 1 wherein the hot gas stream from (1) is passed either in a downward or upward direction through said radiant cooler.

20. The process of claim 1 wherein the hot gas stream from (1) is contacted with at least one atomized spray of calcium-containing material in said radiant cooler and/or in a reaction zone located downstream from said radiant cooler.

21. The process of claim 1 wherein a metallic oxide from the group consisting of copper oxide, zinc oxide, and mixtures thereof is introduced into the radiant cooler in (2) in admixture with said calcium-containing material.

22. The process of claim 1 wherein the calcium-containing material is introduced into the radiant cooling zone in (2) either dry or as a slurry in water.

* * * * *

UNITED STATES PATENT AND TRADEMARK OFFICE

CERTIFICATE OF CORRECTION

PATENT NO. : 4,880,439

DATED : November 14, 1989

INVENTOR(S) : Mitri S. Najjar & Allen M. Robin

It is certified that error appears in the above-identified patent and that said Letters Patent is hereby corrected as shown below:

Column 10 Line 18 - Change "$10^{31\ 15}$" to --$10^{-15}$--

Column 10 Line 20 - Change "$10^{31\ 23}$" to --$10^{-23}$--

Column 10 Line 38 - Change "$10^{31\ 14}$" to --$10^{-14}$--

Column 10 Line 40 - Change "$10^{31\ 10}$" to --$10^{-10}$--

Signed and Sealed this

Twenty-fifth Day of February, 1992

*Attest:*

HARRY F. MANBECK, JR.

*Attesting Officer*

*Commissioner of Patents and Trademarks*